US006494066B2

(12) United States Patent
Muneta

(10) Patent No.: US 6,494,066 B2
(45) Date of Patent: Dec. 17, 2002

(54) CYLINDER LOCK MOUNTING DEVICE

(75) Inventor: Tuyoshi Muneta, Aki-gun (JP)

(73) Assignee: U-SHIN LTD., Tokyo (JP)

( * ) Notice: Subject to any disclaimer, the term of this patent is extended or adjusted under 35 U.S.C. 154(b) by 46 days.

(21) Appl. No.: 09/801,640

(22) Filed: Mar. 9, 2001

(65) Prior Publication Data

US 2002/0124606 A1 Sep. 12, 2002

(51) Int. Cl.[7] ..... E05B 13/00; E05B 9/08

(52) U.S. Cl. ..... 70/208; 292/DIG. 53; 70/370; 70/451; 70/466

(58) Field of Search ..... 70/208, 215, 221, 70/370, 451, 466, 416, 371; 292/DIG. 31, DIG. 53

(56) References Cited

U.S. PATENT DOCUMENTS

| | | | | | |
|---|---|---|---|---|---|
| 452,588 | A | * | 5/1891 | Woolaston | 70/370 |
| 1,024,371 | A | * | 4/1912 | Soley | 70/346 |
| 1,408,477 | A | * | 3/1922 | Schonwald | 70/370 |
| 1,832,362 | A | * | 11/1931 | Cullinan | 137/384.2 |
| 2,086,198 | A | * | 7/1937 | Weston | 248/27.1 |
| 2,506,642 | A | * | 5/1950 | Jacobi | 180/90 |
| 5,297,405 | A | * | 3/1994 | Manning et al. | 292/DIG. 38 |
| 5,987,942 | A | * | 11/1999 | Ichinose | 292/336.3 |
| 5,987,943 | A | * | 11/1999 | Verga et al. | 292/DIG. 31 |

FOREIGN PATENT DOCUMENTS

| | | |
|---|---|---|
| JP | 7-54523 | 2/1995 |

* cited by examiner

*Primary Examiner*—Lloyd A. Gall
*Assistant Examiner*—John B. Walsh
(74) *Attorney, Agent, or Firm*—Wenderoth, Lind & Ponack, L.L.P.

(57) ABSTRACT

A cylinder lock mounting device of the invention comprises: a panel 40 having a cylinder lock insert hole 42 and a cylinder lock mounting hole 41; a cylinder lock 20 provided with a engaging projection 25 and a mounting section 27 on an outer peripheral surface thereof; and an outer handle device 1 to be fixed on an outer surface of the panel 40 by a fastener 62 inserted through the mounting section 27 of the cylinder lock 20 and the cylinder lock mounting hole 41 of the panel 40 from an inside of the panel 40, wherein the engaging projection 25 of the cylinder lock 20 is engaged with a peripheral edge of the cylinder lock insert hole 42 on an outside of the panel 40 by inserting and rotating the cylinder lock 20 in the cylinder lock insert hole 42 of the panel 40.

5 Claims, 4 Drawing Sheets

CYLINDER LOCK MOUNTING DEVICE

BACKGROUND OF THE INVENTION

The present invention relates to a cylinder lock mounting device for mounting a cylinder lock on an automotive door panel or the like.

Such cylinder lock mounting device has been known in the prior art as disclosed in Japanese Patent Laid-Open Publication No. 7-54523. In this cylinder lock mounting device as shown in FIG. 6, a mounting section 110 is protrusively disposed on the outer periphery of a cylinder lock 109, while a cylinder lock mounting hole 105 is formed on a handle base 103, and the cylinder lock 109 is fitted into the cylinder lock mounting hole 105 from the inside (left side in FIG. 6) of a door. The mounting section 110 of the cylinder lock 109 and the handle base 103 are jointly fastened and fixed with a panel 101 interposed therebetween.

A guide section 113 extending to the inside of a door is formed at least on the lower edge of the cylinder lock mounting hole 105, and a fit-in hole 114 is formed on the guide section 113. On the lower surface of the outer periphery of the cylinder lock 109, there is protrusively provided a hook section 115 in a retractable manner.

When the edge portion of the cylinder lock 109 is fitted in the cylinder lock mounting hole 105 along the guide section 113, the hook section 115 on the outer periphery of the cylinder lock 109 is slid down in the retracted state and protrusively fitted into the fit-in hole 114 of the guide section 113 during the fit-in process, which prevents the cylinder lock 109 from dropping off from the handle base 103.

This achieves provisional retainment of the cylinder lock 109, which allows operators to jointly fasten the mounting section 110 of the cylinder lock 109 and the handle base 103 without holding the cylinder lock 109 by hand.

However, in this prior art embodiment, if strong pressing loads are applied to the cylinder lock 109 in the indoor direction after the above-described assembly of the handle base 103 and the cylinder lock 109, the hook section 115 may be slipped out from the fit-in hole 114 on the guide section 113 because of the retractability thereof. If the hook section 115 is slipped out, the cylinder lock 109 is consequently retained in the cantilever support state only by the mounting section 110, which may make a destruction of the cylinder lock 109 relatively easy.

SUMMARY OF THE INVENTION

In view of such problem, it is an object of the present invention to provide a cylinder lock mounting device which prevents application of cantilever loads on the mounting section and which is free from destruction if strong pressing loads are applied to the cylinder lock to implement improved anti-theft functionality.

In order to accomplish the above object, the first aspect of the invention comprises a panel having a cylinder lock insert hole and a cylinder lock mounting hole; a cylinder lock provided with an engaging projection and a mounting section on an outer peripheral surface thereof; and an outer handle device to be fixed on an outer surface of the panel by a fastener(e.g., bolt, rivet, pin, nail or the like) inserted through the mounting section of the cylinder lock and the cylinder lock mounting hole of the panel from an inside of the panel, wherein the engaging projection of the cylinder lock is engaged with a peripheral edge of the cylinder lock insert hole on an outside of the panel by inserting and rotating the cylinder lock in the cylinder lock insert hole of the panel.

According to the first aspect of the invention, the cylinder lock mounting device has the engaging projection which is engaged with the peripheral edge of the cylinder lock insert hole on the outside of the panel, so that even if strongly pressed down from the front side of the cylinder lock toward the inside of panel, the cylinder lock mounting device is free from application of cantilever loads to the mounting section because the engaging projection engaged with the panel resists the press force, which results in the difficulty of destruction on the cylinder lock and implements improved anti-theft functionality.

In the second aspect of the invention, the engaging projection and the mounting section of the cylinder lock are covered with the outer handle device.

According to the second aspect of the invention, the engaging projection and the mounting section of the cylinder lock are covered with the outer handle device, so that they are not visible from the outside. Consequently, it is impossible to attack and destroy the engaging projection and the mounting section, which makes it possible to implement improved anti-theft functionality.

In the third aspect of the invention, the mounting section of the cylinder lock is provided on a part of a flange section formed on an outer peripheral surface of the cylinder lock.

According to the third aspect of the invention, the mounting section of the cylinder lock is provided on a part of the flange section formed on the outer peripheral surface of the cylinder lock. This flange section retains the cylinder lock stably, and at the same time the cylinder lock is hold on the panel by the engaging projection and the flange section, so that if the outer handle device should be destructed, it is impossible to rotate the cylinder lock, which implements high anti-theft functionality.

In the forth aspect of the invention, a retainment projection which penetrates through the panel and projects from an inner surface of the panel is formed on the outer handle device, a flange section is formed on an outer peripheral surface of the cylinder lock, and the retainment projection is engaged with a part of the flange section of the cylinder lock by inserting and rotating the cylinder lock in the cylinder lock insert hole of the panel.

According to the fourth aspect of the invention, the retainment projection is engaged with the part of the flange section of the cylinder lock with the panel interposed between the outer handle device and the flange section of the cylinder lock, so that the outer handle device is provisionally retained to the panel and not surfaced from the panel.

In the fifth aspect of the invention, a rotation of the cylinder lock is stopped when the retainment projection of the outer handle device is engaged with the flange section of the cylinder lock, and at this time a position of the mounting section on the cylinder lock corresponds with a position of cylinder lock mounting hole on the panel.

According to the fifth aspect of the invention, the position of the mounting section on the cylinder lock corresponds with the position of the cylinder lock mounting hole on the panel when the retainment projection is engaged with the flange section, so that the fastener can be inserted into the mounting section on the cylinder lock and the cylinder lock mounting hole on the panel without the step of special positioning, which implements high assembling efficiency.

BRIEF DESCRIPTION OF THE DRAWINGS

The present invention will be further described with reference to the accompanying drawings wherein like reference numerals refer to like parts in the several views, and wherein:

FIG. 5 is a view showing from the backside a cylinder lock and an outer handle device to be mounted on a panel, in which

DETAILED DESCRIPTION OF THE PREFERRED EMBODIMENTS

Figure 1:
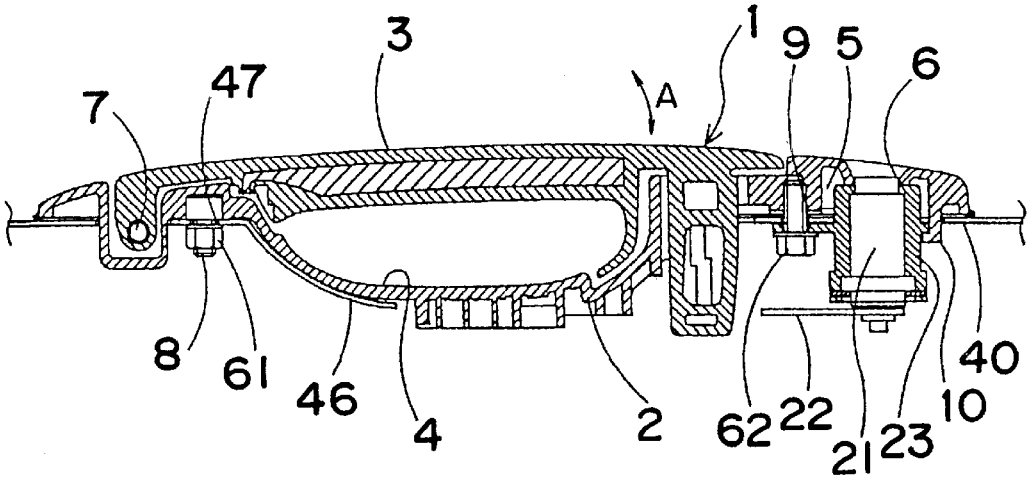
FIG. 1 is a cross sectional front view showing a cylinder lock and an outer handle device mounted on a door panel.
Figure 2:
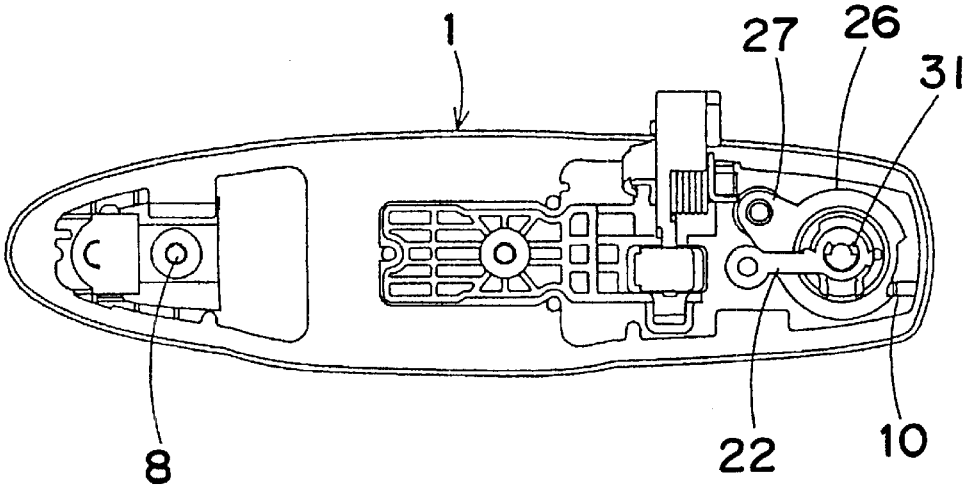
FIG. 2 is a bottom view of FIG. 1 with the door panel omitted.

FIGS. 1, 2, 3 and 4 show a cylinder lock mounting device of one embodiment according to the present invention. The cylinder lock mounting device comprises a outer handle device 1 mounted on a panel 40 and a cylinder lock 20 attached to the outer handle device 1.

The outer handle device 1 is made up of a handle base 2, and a handle member 3 which is mounted on the handle base 2 so as to rotate about an axis 7 within a certain extent in a direction shown by a arrow A.

In the central portion of the handle base 2, there is provided a concave section 4 on the back side (lower side in FIG. 1) so as to allow insertion of a human hand. In the end portion 2*a* of the handle base 2, there is formed a cylinder lock accommodating section 5. On the front side of the cylinder lock accommodating section 5 (upper side in FIG. 1), there is provided an opening 6. On the back side of the handle base 2, there is formed a retainment projection 10 having a folded end 11 and a mounting hole 9 having a female screw adjacent to the cylinder lock accommodation section 5. In addition, on the back side of the handle base 2, there is protrusively provided a screw 8.

The cylinder lock 20 has a rotor 21 rotated by insertion of a matching key (not illustrated) and a holder 23 for retaining the rotor 21 in a rotatable manner.

The holder 23 is mainly constituted by an approximately cylinder-shaped cylinder section 24. On the outer peripheral surface of the cylinder section 24, there are protrusively provided a pair of engaging projections 25 (see FIG. 4), and a flange section 26 apart from the engaging projections 25 by a specified distance. It is noted that a number of the engaging projection 25 is not limited to two, it may be three or more. On the flange section 26, there is provided an extended section 27 serving as a mounting section. On the central portion of the extended section 27, there is formed a screw insert hole 28. On the flange section 26, there is also formed a recess 29 for evading an interference with the retainment projection 10 formed on the handle base 2. One end edge of the recess 29 serves as an engaging section 30 to engage with the retainment projection 10.

The engaging projections 25 and extended section 27 are both covered with the handle base 2 so as to be invisible from the outside.

A key lever 22 is mounted on the rotor 21 with the aid of a snap ring 31. When the matching key is inserted to the rotor 21 from the outside of the outer handle device 1 and rotated, the key lever 22 is interlocked to drive a door lock device through a rod not illustrated. On the back side of the rotor 21, there is formed another flange section 32, which is retained by a retaining plate 33 so as to prevent the rotor 21 from dropping off from the holder 23.

Figure 4:
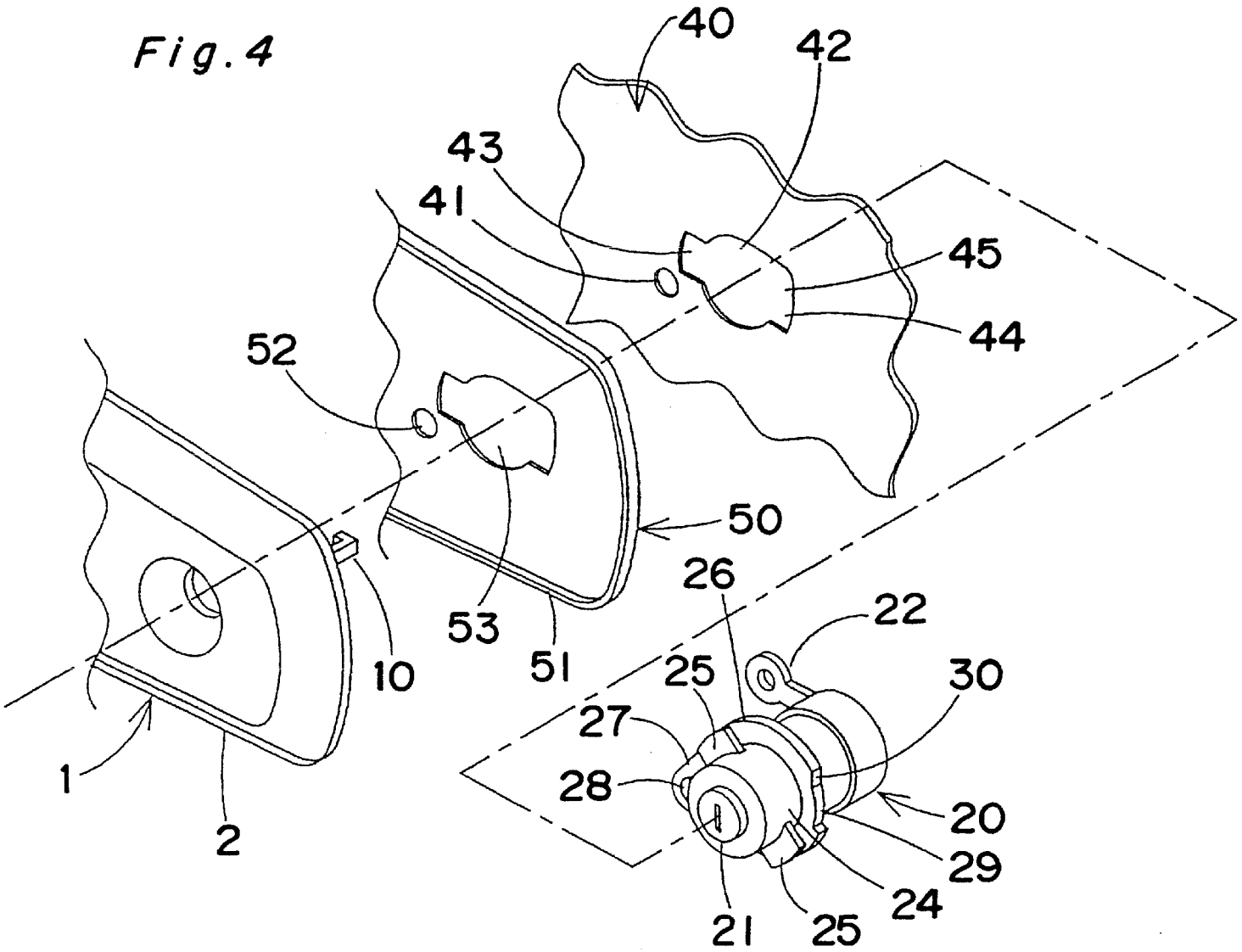
FIG. 4 is a exploded perspective view showing a cylinder lock and an outer handle device prior to be mounted on the panel.

The panel 40 on which the outer handle device 1 and the cylinder lock 20 are fixed has a cylinder lock mounting hole 41 and a cylinder lock insert hole 42 for inserting the cylinder lock 20 (see FIG. 4). The cylinder lock insert hole 42 has concave sections 43 and 44. The concave section 44 is given a recess 45 for evading the interference with an insertion of the retainment projection 10 protrusively provided on the handle base 2. The panel 40 further has a concave section 46 for accommodating the concave section 4 of the handle base 2 and an insert hole 47 for inserting the screw 8 of the handle base 2.

A handle sheet 50 (see FIG. 4) is sustained in between the handle base 2 and the panel 40 assembled with each other. On the periphery of the handle sheet 50, there is protrusively provided a rib 51. At the same position with the cylinder lock mounting hole 41 and the cylinder lock insert hole 42 on the panel 40, there are formed a screw insert hole 52 and a cylinder lock insert hole 53 in approximately the same shapes therewith.

Reference numeral 61 denotes a nut that is combined with a mounting screw 8 on the handle base 2 to fix the outer handle device 1 on the panel 40. Reference numeral 62 denotes a mounting bolt that is combined with the mounting hole 9 of the handle base 2 to fasten the outer handle device 1 and the cylinder lock 20.

The outer handle device 1 and the cylinder lock 20 are mounted on the panel 40 based on the following steps.

First, the handle sheet 50 is attached to the handle base 2 of the outer handle device 1 in the state that the rib 51 of the handle sheet 50 is fitted into the periphery of the handle base 2. Thereafter, the mounting screw 8 on the handle base 2 is inserted into the screw insert hole 47 on the panel 40.

Figure 5A:
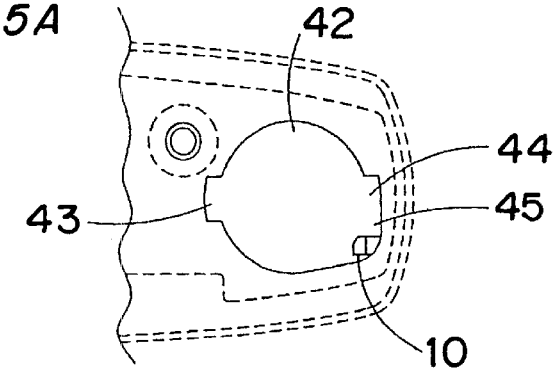
FIG. 5A is a view showing the position of a retainment projection in the state that the outer handle device is mounted on the panel.

Consequently, the outer handle device 1 is provisionally retained to the panel 40 with the handle sheet 50 interposed. At this point, the retainment projection 10 protrusively provided on the handle base 2 is extended to the back side (front side in FIG. 5A) of the panel 40 through the recess 45 of the cylinder lock insert hole 42 formed on the panel 40.

Figure 5B:
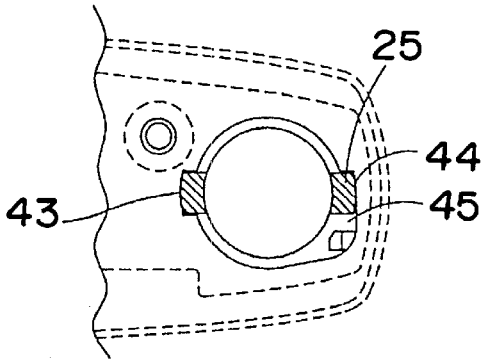
FIG. 5B is a view showing the position of a engaging projection in the state that the cylinder lock is fitted into the panel.

Next, the cylinder lock 20 is inserted into the cylinder lock insert hole 42 on the panel 40 from the back side (lower side in FIG. 1) and fitted into the cylinder lock accommodating section 5 formed on the handle base 2. At this point, as shown in FIG. 5B, the engaging projections 25 of the cylinder lock 20 are inserted across the concave sections 43 and 44 of the cylinder lock insert hole 42 on the panel 40. At the same time, the retainment projection 10 projected to the back side of the panel 40 is, as shown in FIG. 5C, located inside the recess 29 of the flange section 26, so that the retainment projection 10 does not hinder insertion of the cylinder lock 20.

The front portion of the rotor 21 of the cylinder lock 20 is fitted into the opening 6 of the handle base 2 in a rotative manner.

Figure 3:
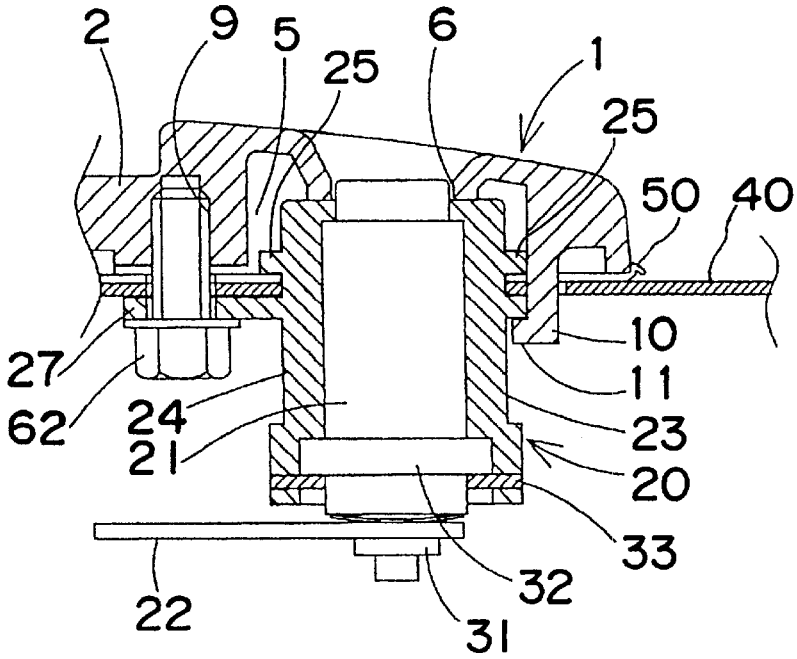
FIG. 3 is an enlarged cross sectional view showing a part adjacent to a cylinder lock in FIG. 1.
Figure 6:
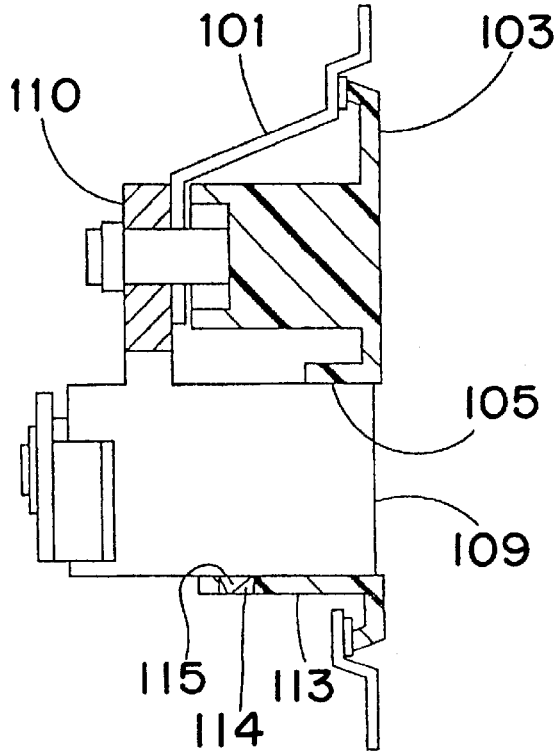
Fig. 6 PRIOR ART
FIG. 6 is a cross sectional side view showing a prior art embodiment.
Figure 5C:
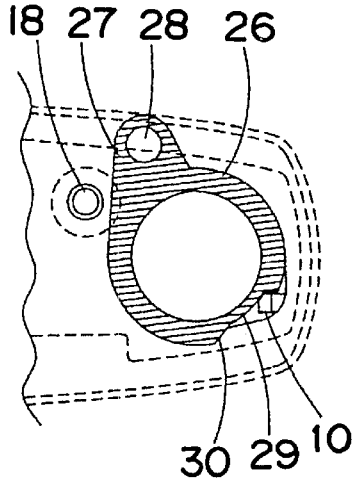
FIG. 5C is a view showing the position of a flange section of the cylinder lock.
Figure 5D:
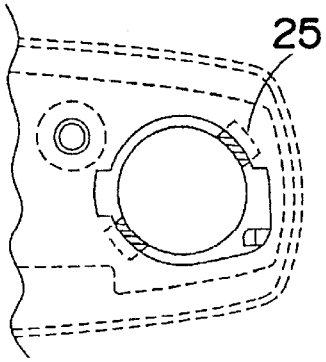
FIG. 5D is a view showing the cylinder lock rotated so as to engage the engaging projection to the panel.
Figure 5E:
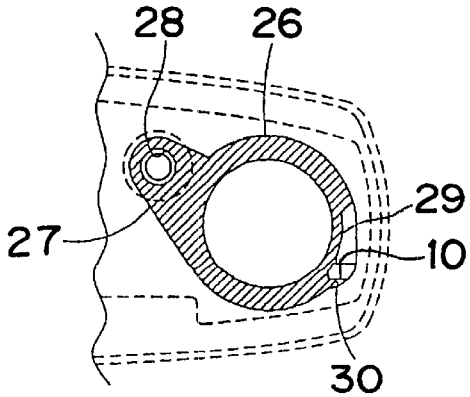
FIG. 5E is a view showing the retainment projection engaged with the flange section.

In this state as shown in FIGS. 5B and 5C, the cylinder lock 20 is rotated counterclockwise. Consequently, the engaging section 30 on the flange section 26 comes into contact with the retainment projection 10 and engaged therewith, by which rotation of cylinder lock 20 is stopped. At this point, as shown in FIG. 5D, the engaging projections 25 are engaged with the peripheral edge of the cylinder lock insert hole 42 on an outside of the panel 40 with the handle sheet 50 interposed, by which the cylinder lock 20 is provisionally retained to the panel 40. At the same time, the engaging section 30 on the flange section 26 is, as shown in FIGS. 5E and 3, engaged with the folded end 11 of the retainment projection 10, by which a shift of the handle base 2 to the front side from the panel 40 is hindered and the outer handle device 1 is also provisionally retained to the panel 40. In the state that the rotation of the cylinder lock 20 was stopped, a position of the screw insert hole 28 formed on the extended section 27 of the flange section 26 is set to correspond with positions of the mounting hole 9 on the handle base 2 and the cylinder lock mounting hole 41 on the panel 40.

Finally, as shown in FIG. 1, the nut 61 is screwed on the mounting screw 8, and the mounting bolt 62 is inserted into the screw insert hole 28 on the extended section 27 of the flange section 26 and screwed into the mounting hole 9 on the handle base 2, by which the outer handle device 1 and the cylinder lock 20 is mounted on the panel 40.

At this point, the mounting bolt 62 can be inserted into the screw insert hole 28 on the extended section 27 of the flange section 26 and screwed into the mounting hole 9 on the handle base 2 without the step of special positioning because the position of the screw insert hole 28 has been matched with the positions of the mounting hole 9 on the handle base 2 and the cylinder lock mounting hole 41 on the panel 40 as described above, which implements high assembling efficiency.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included thereto.

What is claimed is:

1. A cylinder lock mounting device comprising: a panel having a cylinder lock insert hole and a cylinder lock mounting hole; a cylinder lock provided with an engaging projection and a mounting section on an outer peripheral surface thereof; and an outer handle device to be fixed on an outer surface of the panel by a fastener inserted through the mounting section of the cylinder lock and the cylinder lock mounting hole of the panel from an inside of the panel, wherein the engaging projection of the cylinder lock is engaged with a peripheral edge of the cylinder lock insert hole on an outside of the panel by inserting and rotating the cylinder lock in the cylinder lock insertion hole of the panel.

2. The cylinder lock mounting device as defined in claim 1, wherein the engaging projection and the mounting section of the cylinder lock are covered with the outer handle device.

3. The cylinder lock mounting device as defined in claim 1, wherein the mounting section of the cylinder lock is provided on a part of a flange section formed on an outer peripheral surface of the cylinder lock.

4. The cylinder lock mounting device as defined in claim 1, wherein a retainment projection which penetrates through the panel and projects from an inner surface of the panel is formed on the outer handle device, a flange section is formed on an outer peripheral surface of the cylinder lock, and the retainment projection is engaged with a part of the flange section of the cylinder lock by inserting and rotating the cylinder lock in the cylinder lock insertion hole of the panel.

5. The cylinder lock mounting device as defined in claim 4, wherein a rotation of the cylinder lock is stopped when the retainment projection is engaged with the flange section, and at this point a position of the mounting section on the cylinder lock corresponds with a position of the cylinder lock mounting hole of the panel.

* * * * *